US006182945B1

(12) United States Patent
Dyer et al.

(10) Patent No.: US 6,182,945 B1
(45) Date of Patent: Feb. 6, 2001

(54) REDUNDANT DRAWWORKS

(75) Inventors: Norman D. Dyer, Houston; Kenneth S. Kondo, League City, both of TX (US)

(73) Assignee: National Oilwell, L.P., Houston, TX (US)

( * ) Notice: Under 35 U.S.C. 154(b), the term of this patent shall be extended for 0 days.

(21) Appl. No.: 08/914,908

(22) Filed: Aug. 18, 1997

Related U.S. Application Data

(60) Provisional application No. 60/025,195, filed on Sep. 12, 1996.

(51) Int. Cl.[7] ..... B66D 1/14

(52) U.S. Cl. ..... 254/340; 254/342; 254/378

(58) Field of Search ..... 254/363, 342, 254/362, 377, 378, 379, 340

(56) References Cited

U.S. PATENT DOCUMENTS

| | | |
|---|---|---|
| 2,263,961 | 11/1941 | Wilson . |
| 3,002,560 | 10/1961 | Paget . |
| 3,506,095 | 4/1970 | Weaver . |
| 3,738,614 | 6/1973 | Peterson . |
| 3,981,485 | 9/1976 | Eddy et al. . |
| 4,073,476 | 2/1978 | Frank . |
| 4,098,139 | 7/1978 | Sankey . |
| 4,220,222 | 9/1980 | Kamaike et al. . |
| 4,434,875 | 3/1984 | Scarzella . |
| 4,533,021 | 8/1985 | Perez de la Orden . |
| 4,577,693 | 3/1986 | Graser . |
| 4,696,377 | 9/1987 | Richardson et al. . |

FOREIGN PATENT DOCUMENTS

| | | |
|---|---|---|
| 2647543B1 | 1/1978 | (DE) . |
| 3933505A1 | 4/1990 | (DE) . |
| 2081769 | 12/1971 | (FR) . |
| 2031363 | 4/1980 | (GB) . |

OTHER PUBLICATIONS

National Oilwell regenerative drawworks 4310 DCG, Aug. 29, 1996.*

* cited by examiner

*Primary Examiner*—Katherine A. Matecki
(74) *Attorney, Agent, or Firm*—Goldstein & Healey, L.L.P.

(57) ABSTRACT

A fully redundant drawworks is provided with two complete and totally independent systems for controlling and powering the drum and drum shaft of the drawworks. Each system broadly comprises at least one source of power (e.g., a motor or engine), a power transmission means, preferably of the gear or chain type, and some means of mechanically coupling the power source, transmission and drum shaft together. Each system may also be provided with a brake means, such as one or more disc, band, electric or water-cooled brakes. In the event that any component of either system fails, the fully redundant drawworks will still have the ability to raise drill pipe from a bore hole and thus avoid the risk of a "stuck" drill pipe.

6 Claims, 4 Drawing Sheets

REDUNDANT DRAWWORKS

RELATED APPLICATIONS

This application claims the benefit of U. S. Provisional Application Ser. No. 60/025,195, filed Sep. 12, 1996.

BACKGROUND OF THE INVENTION

1. Field of the Invention

This invention relates generally to oil field equipment, and more particularly to an improved drawworks.

2. Description of the Related Art

A drawworks, sometimes referred to as a hoist, is a large piece of oil field equipment which can broadly be described as a very large winch. The drawworks is mounted on an oil or gas well drilling rig, its sole function being to raise and lower drill pipe and casing into and out of the bore hole. Typically, a drawworks is provided with: a hollow drum which is coaxially mounted on a drum shaft; a source of power to cause the drum shaft and drum to rotate; some means of transmitting power from the power source to the drum shaft; and, some means of braking the drum. The drawworks is mounted on the drilling rig such that the longitudinal center axis of the drum and drum shaft is coplanar with the drilling rig platform, or horizontal. Examples of the power source are AC motors, DC motors, and diesel or other types of engines. The power is generally transmitted from the power source to the drum shaft either by (1) a chain transmission mechanism or (2) a gear transmission mechanism. The drum can be braked in a number of ways, examples of which are by disc brakes, band brakes, water-cooled brakes, electric brakes, or by the power source. The drum is wrapped with a length of wireline, normally not provided with the drawworks. The wireline is fed upwardly from the drawworks to the top of the oil derrick and then downwardly such that it can be attached to the drill pipe or casing. Between the top and bottom of the derrick, the wireline is passed through a series of sheaves (or pulleys), which are housed within a crown block and traveling block. The lowermost end of the wireline is attached to a hook and swivel arrangement, to which the drill pipe and casing may be releasably attached, and thereby raised and lowered.

Problems can arise with conventional drawworks of the type described above. One very serious problem, which the present invention is believed to solve, arises in the event that one of the components of the drawworks fails. The most common failures are mechanical in nature, and occur either in the power source (motor or engine) or in the gear or chain mechanism. In the event that such a mechanical failure occurs, the drawworks will become completely disabled, and thus unable to perform its function. If the failure can be quickly remedied, and the drawworks quickly restored to operation, then no problems should arise. However, in the event that the failure is of such a serious nature that it cannot be quickly remedied, such that the entire drilling operation must be halted for a period of time, then it is almost inevitable that the drill pipe will become "stuck" in the bore hole. The drill pipe becomes "stuck" because, after sitting in the same position for an extended period of time, rock, dirt and other debris tends to cave in around the pipe and on top of the drilling bit, which is attached to the lowermost end of the drill pipe. Those skilled in the oil well drilling industry know that a "stuck" drill pipe can be disastrous and extremely expensive to remedy, and could potentially lead to the bore hole being completely abandoned. The drawworks of the present invention was developed to reduce the risk of the drill pipe becoming "stuck." As will be more fully described below, the drawworks of the present invention is provided with complete redundancy, which means that if a mechanical failure occurs, the drawworks will still have the ability to raise the drill pipe out of the well hole, or at least up into the casing, before the drill pipe becomes "stuck."

SUMMARY OF THE INVENTION

The present invention is directed generally to an improved drawworks. A specific embodiment of the drawworks of the present invention comprises: a mounting base (or skid); a drum; a drum shaft; a left gear box; a right gear box; a left brake; a right brake; a lower left motor; an upper left motor; a lower right motor; and an upper right motor. The drum is mounted to the drum shaft in a conventional manner within the drum housing. The drawworks may also be provided with a drum housing which may be provided with an opening through which the wireline passes. The drum shaft runs the full length of the drawworks, and passes through and is rotatably mounted (with bearings at appropriate locations) within each of the respective shaft bores provided within the left brake, the left gear box, the drum housing, the drum, the right gear box, and the right brake. The upper left motor is positioned above the lower left motor and nearer to the drum. Likewise, the upper right motor is positioned above the lower right motor and nearer to the drum. The left motors are coupled to the input shafts of the left gear box by mechanical couplers. Likewise, the right motors are coupled to the input shafts of the right gear box by mechanical couplers. The left and right brakes provide the drawworks with sufficient braking capability to control the rotation of the drum as the wireline is being fed out to lower the drill pipe or casing.

In another aspect, the redundant drawworks of the present invention includes: a mounting base; a left gear box secured to the mounting base; a right gear box secured to the mounting base; a drum rotatably coupled to the left and right gear boxes; at least one left motor secured to the mounting base and coupled to the left gear box; and at least one right motor secured to the mounting base and coupled to the right gear box, whereby the drum is powered by the at least one left and right motors through their respective gear boxes, the at least one left motor and the at least one right motor being able to power the drum through their respective gear boxes independently of each other. Another feature of this aspect of the present invention is that the drawworks may further include a drum shaft, wherein the drum is mounted to the drum shaft, and the drum shaft is rotatably coupled to the left and right gear boxes. Another feature of this aspect of the present invention is that the drawworks may further include a drum housing between the left and right gear boxes, wherein the drum is rotatably mounted within the drum housing and coupled to the left and right gear boxes. Another feature of this aspect of the present invention is that the drawworks may further include a drum shaft, wherein the drum is mounted to the drum shaft, and the drum shaft is rotatably mounted within shaft bores on the drum housing, the left gear box, and the right gear box. Another feature of this aspect of the present invention is that the drawworks may further include a left brake coupled to the drum shaft and a right brake coupled to the drum shaft. Another feature of this aspect of the present invention is that the left and right brakes may be disc brakes. Another feature of this aspect of the present invention is that the left and right brakes may be band brakes. Another feature of this aspect of the present invention is that the left and right brakes may be water-cooled brakes. Another feature of this aspect of the present invention is that the left and right brakes may be electric brakes. Another feature of this aspect of the present invention is that each gear box may be a gear reduction collector drive with an integral three-speed mechanical gear transmission. Another feature of this aspect of the present invention is that each gear box may be a single-speed mechanical gear transmission. Another feature of this aspect of the present invention is that each gear box may be a multiple-speed mechanical gear transmission. Another feature of this aspect of the present invention is that each gear box may include a collector gear drive and at least one multiple-speed gear transmission, the collector gear drive being coupled to the at least one multiple-speed gear transmission and to the drum, and the at least one multiple-speed gear transmission being coupled to the respective at least one motor. Another feature of this aspect of the present invention is that power may be transferred to the drum only from the at least one left motor through the left gear box. Another feature of this aspect of the present invention is that preventative maintenance may be performed on the at least one right motor and right gear box while power is being transferred to the drum only from the at least one left motor through the left gear box. Another feature of this aspect of the present invention is that power may be transferred to the drum only from the at least one right motor through the right gear box. Another feature of this aspect of the present invention is that preventative maintenance may be performed on the at least one left motor and left gear box while power is being transferred to the drum only from the at least one right motor through the right gear box. Another feature of this aspect of the present invention is that the at least one left and right motors are each provided with the capacity to apply a braking force to the drum.

In another aspect, the redundant drawworks of the present invention may include: a mounting base; a left gear box secured to the mounting base; a right gear box secured to the mounting base; a drum mounted to a drum shaft, the drum shaft being rotatably coupled to the left and right gear boxes; at least one left motor secured to the mounting base and coupled to the left gear box; at least one right motor secured to the mounting base and coupled to the right gear box; a left brake coupled to the drum; and a right brake coupled to the drum; whereby the drum is powered by the at least one left and right motors through their respective gear boxes, the at least one left motor and the at least one right motor being able to power the drum through their respective gear boxes independently of each other. Another feature of this aspect of the present invention is that the drawworks may further include a drum housing between the left and right gear boxes, wherein the drum is rotatably mounted within the drum housing. Another feature of this aspect of the present invention is that the drum shaft may be rotatably mounted within shaft bores on the left gear box, the right gear box, the left brake, and the right brake. Another feature of this aspect of the present invention is that the left and right brakes may be disc brakes. Another feature of this aspect of the present invention is that the left and right brakes may be band brakes. Another feature of this aspect of the present invention is that the left and right brakes may be water-cooled brakes. Another feature of this aspect of the present invention is that the left and right brakes may be electric brakes. Another feature of this aspect of the present invention is that each gear box may be a gear reduction collector drive with an integral three-speed mechanical gear transmission. Another feature of this aspect of the present invention is that each gear box may be a single-speed mechanical gear transmission. Another feature of this aspect of the present invention is that each gear box may be a multiple-speed mechanical gear transmission. Another feature of this aspect of the present invention is that each gear box may include a collector gear drive and at least one multiple-speed gear transmission, the collector gear drive being coupled to the at least one multiple-speed gear transmission and to the drum, and the at least one multiple-speed gear transmission being coupled to the respective at least one motor. Another feature of this aspect of the present invention is that power may be transferred to the drum only from the at least one left motor through the left gear box. Another feature of this aspect of the present invention is that preventative maintenance may be performed on the at least one right motor and right gear box while power is being transferred to the drum only from the at least one left motor through the left gear box. Another feature of this aspect of the present invention is that power may be transferred to the drum only from the at least one right motor through the right gear box. Another feature of this aspect of the present invention is that preventative maintenance may be performed on the at least one left motor and left gear box while power is being transferred to the drum only from the at least one right motor through the right gear box. Another feature of this aspect of the present invention is that the at least one left and right motors are each provided with the capacity to apply a braking force to the drum.

In another aspect, the redundant drawworks of the present invention may include: a mounting base; a left gear transmission assembly secured to the mounting base and having a collector gear drive and a first and a second multiple-speed gear transmission, the collector gear drive being coupled to the first and second multiple-speed gear transmissions; a right gear transmission assembly secured to the mounting base and having a collector gear drive and a first and a second multiple-speed gear transmission, the collector gear drive being coupled to the first and second multiple-speed gear transmissions; a drum mounted to a drum shaft, the drum shaft being rotatably coupled to the respective collector gear drives of the left and right gear transmission assemblies; a first and second left motor secured to the mounting base, the first left motor being coupled to the first multiple-speed gear transmission on the left gear transmission assembly, and the second left motor being coupled to the second multiple-speed gear transmission on the left gear transmission assembly; a first and second right motor secured to the mounting base, the first right motor being coupled to the first multiple-speed gear transmission on the right gear transmission assembly, and the second right motor being coupled to the second multiple-speed gear transmission on the right gear transmission assembly; whereby the drum is powered by the left and right motors through their respective gear transmission assemblies, and wherein either of the left motors and either of the right motors can power the drum through their respective gear transmission assemblies independently of each other. Another feature of this aspect of the present invention is that the drawworks may further include a left brake secured to the mounting base and coupled to the drum shaft, and a right brake secured to the mounting base and coupled to the drum shaft. Another feature of this aspect of the present invention is that the drawworks may further include a drum housing between the left and right gear transmission assemblies, and wherein the drum shaft is rotatably mounted within shaft bores on the drum housing, the respective collector gear drives of the left and right gear transmission assemblies, the left brake, and the right brake. Another feature of this aspect of the present invention is that the left and right brakes may be disc brakes. Another feature of this aspect of the present invention is that the left and right brakes may be band brakes. Another feature of this aspect of the present invention is that the left and right brakes may be water-cooled brakes. Another feature of this aspect of the present invention is that the left and right brake may be electric brakes. Another feature of this aspect of the present invention is that power may be transferred to the drum only through the left gear transmission assembly. Another feature of this aspect of the present invention is that preventative maintenance may be performed on the right motors and right gear transmission assembly while power is being transferred to the drum only through the left gear transmission assembly. Another feature of this aspect of the present invention is that power may be transferred to the drum only through the right gear transmission assembly. Another feature of this aspect of the present invention is that preventative maintenance may be performed on the left motors and left gear transmission assembly while power is being transferred to the drum only through the right gear transmission assembly. Another feature of this aspect of the present invention is that each of the left and right motors are provided with the capacity to apply a braking force to the drum. Another feature of this aspect of the present invention is that the multiple-speed transmissions may be three-speed transmissions. Another feature of this aspect of the present invention is that the first left motor may be positioned above and nearer the drum than the second left motor, and the first right motor may be positioned above and nearer the drum than the second right motor.

In another aspect, the redundant drawworks of the present invention may include: a mounting base; a drum rotatably mounted on the mounting base; a left power means for powering the drum; a right power means for powering the drum; a left transmission means for transmitting power from the left power means to the drum, the left transmission means being secured to the mounting base and coupled to the left power means and to the drum; a right transmission means for transmitting power from the right power means to the drum, the right transmission means being secured to the mounting base and coupled to the right power means and to the drum; whereby the drum is powered by the left and right power means through their respective transmission means, and wherein both the left power means and the right power means can power the drum through their respective transmission means independently of each other. Another feature of this aspect of the present invention is that the drawworks may further include brake means for applying a braking force to the drum. Another feature of this aspect of the present invention is that the brake means may include at least one disc brake. Another feature of this aspect of the present invention is that the brake means may include at least one band brake. Another feature of this aspect of the present invention is that the brake means may include at least one water-cooled brake. Another feature of this aspect of the present invention is that the brake means may include at least one electric brake. Another feature of this aspect of the present invention is that the left transmission means may include a collector gear drive and at least one multiple-speed gear transmission, the collector gear drive being coupled to the at least one multiple-speed gear transmission and to the drum, the at least one multiple-speed gear transmission being coupled to the left power means; and the right transmission means may include a collector gear drive and at least one multiple-speed gear transmission, the collector gear drive being coupled to the at least one multiple-speed gear transmission and to the drum, the at least one multiple-speed gear transmission being coupled to the right power means. Another feature of this aspect of the present invention is that each transmission means may be a chain transmission. Another feature of this aspect of the present invention is that each transmission means may be a gear reduction collector drive with an integral three-speed mechanical gear transmission. Another feature of this aspect of the present invention is that each transmission means may be a single-speed mechanical gear transmission. Another feature of this aspect of the present invention is that each transmission means may be a multiple-speed mechanical gear transmission. Another feature of this aspect of the present invention is that power may be transferred to the drum only from the left power means through the left transmission means. Another feature of this aspect of the present invention is that preventative maintenance may be performed on the right power means and right transmission means while power is being transferred to the drum only from the left power means through the left transmission means. Another feature of this aspect of the present invention is that the power is transferred to the drum only from the right power means through the right transmission means. Another feature of this aspect of the present invention is that preventative maintenance may be performed on the left power means and left transmission means while power is being transferred to the drum only from the right power means through the right transmission means. Another feature of this aspect of the present invention is that the left and right power means are each provided with the capacity to apply a braking force to the drum.

The drawworks of the present invention is fully redundant, meaning that the drawworks is provided with two complete, separate and independent systems for powering and controlling the drum, those two systems being: (1) the left system, which broadly comprises the upper and lower left motors, the left gear box, mechanical couplers, and the left brake; and (2) the right system, which broadly comprises upper and lower right motors, the right gear box, mechanical couplers, and the right brake. Thus, in the event that any motor, gear box, coupler or brake fails, the drawworks will still have the ability to raise the drill pipe out of the bore hole, or at least up into the casing, before the drill pipe becomes "stuck," thereby avoiding a very expensive and troublesome situation. In addition to significantly reducing the risk of a "stuck" pipe, the full redundancy provided with the drawworks of the present invention has the additional benefit of allowing the drilling crew to service or conduct preventative maintenance on one of the two systems without requiring the entire drilling operation to be halted. The drawworks can be made redundant by providing each system with single motors, and with chain transmissions instead of gear transmissions.

DETAILED DESCRIPTION OF THE INVENTION

Figure 1:
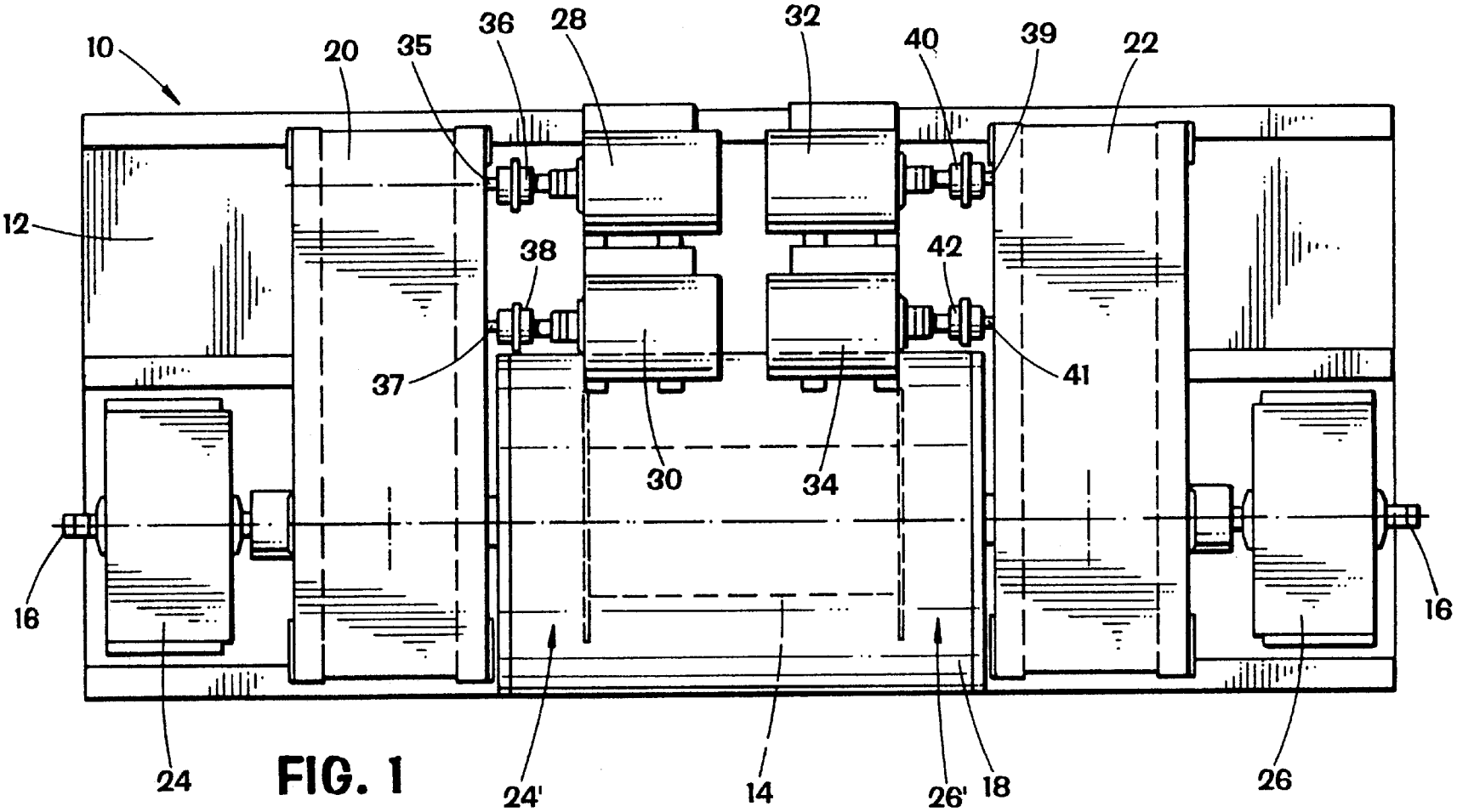
FIG. 1 is a top view of the drawworks of the present invention.
Figure 2:
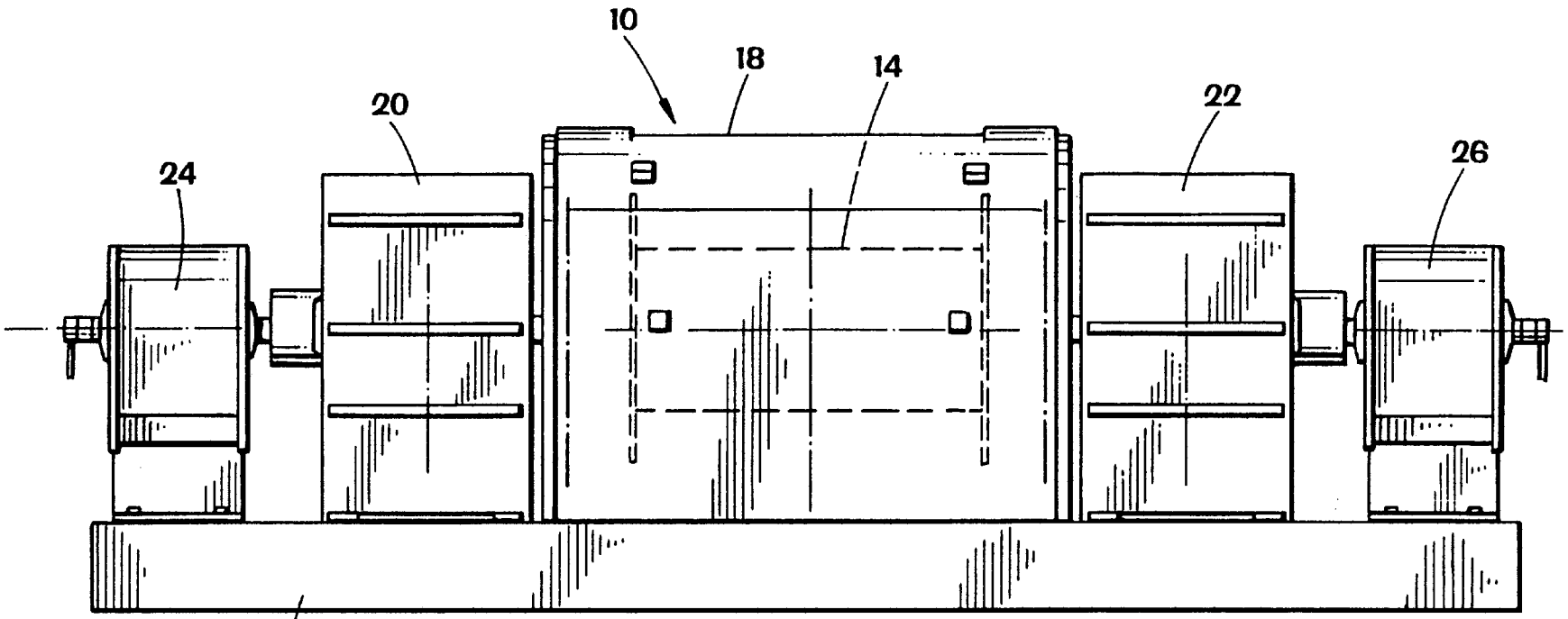
FIG. 2 is a front elevation view of the drawworks shown in FIG. 1.
Figure 3:
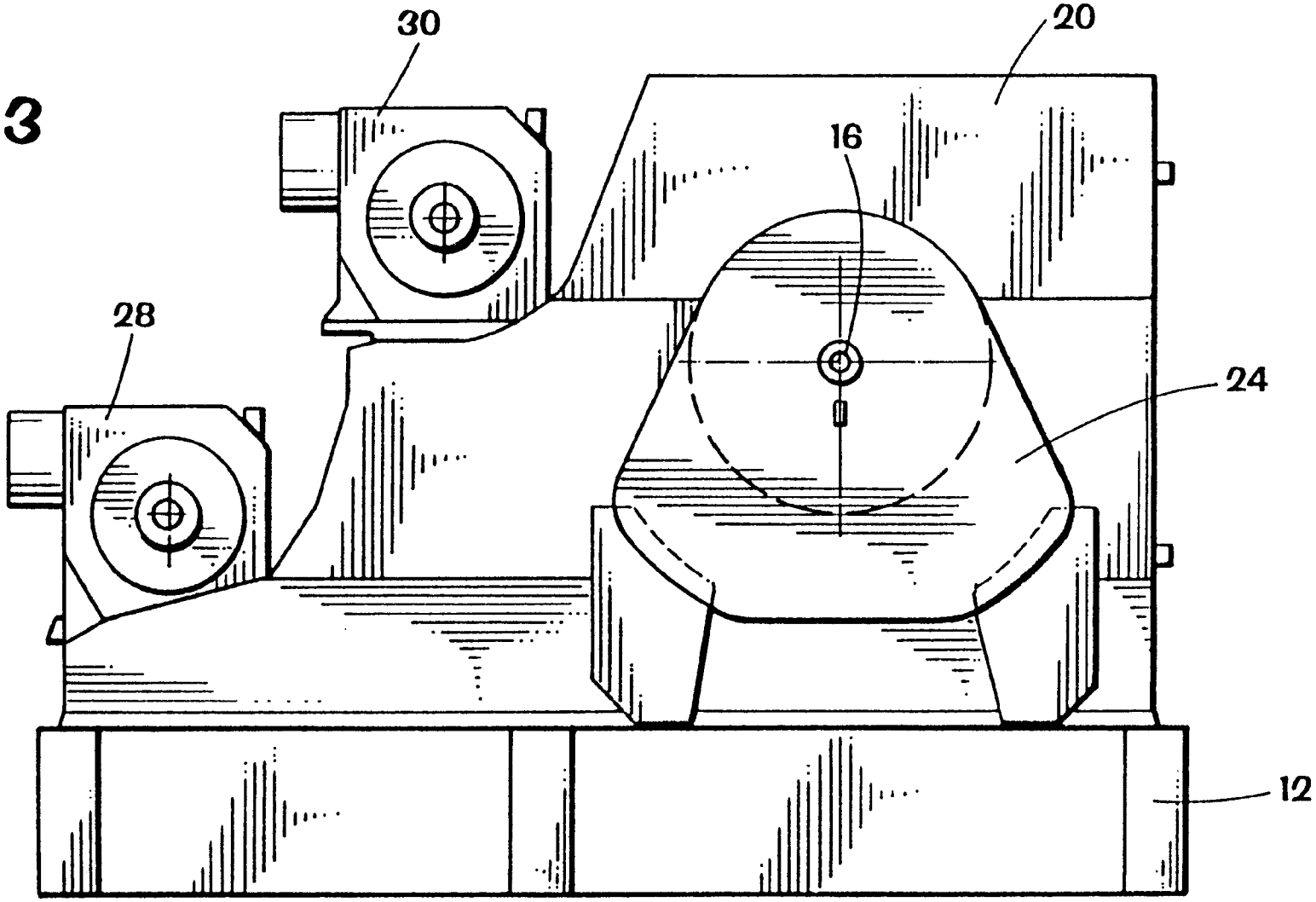
FIG. 3 is a side elevation view of the left side of the drawworks shown in FIGS. 1 and 2, and more particularly shows the left side of the left gear box partially cut away so as to illustrate the relative positions of the upper and lower left motors.

Referring to the drawings in detail, wherein like numerals denote identical elements throughout the several views, there is shown in FIG. 1 a specific embodiment of a drawworks 10 constructed in accordance with the present invention. With reference to FIGS. 1–3, the drawworks 10 of this specific embodiment broadly comprises: a mounting base (or skid) 12; a drum 14; a drum shaft 16; a left gear box 20; a right gear box 22; a left brake 24; a right brake 26; a lower left motor 28; an upper left motor 30; a lower right motor 32; and an upper right motor 34. In a specific embodiment, the skid 12 may be a heavy duty oil field skid, approximately 30' long×14' wide, and the drum 14 may be a smooth drum with approximately 2" Lebus split-sleeve grooving and may have an approximate width of 8' and an approximate diameter of 4'. The drum 14 is mounted to the drum shaft 16 in a conventional manner. The drawworks 10 may also be provided with a drum housing 18 which may be provided with an opening (not shown) through which the wireline (not shown) passes. The drum shaft 16 runs the full length of the drawworks 10, and passes through, and is rotatably mounted (with bearings at appropriate locations) within, each of the respective shaft bores provided within the left brake 24, the left gear box 20, the drum housing 18, the drum 14, the right gear box 22, and the right brake 26.

Figure 4:
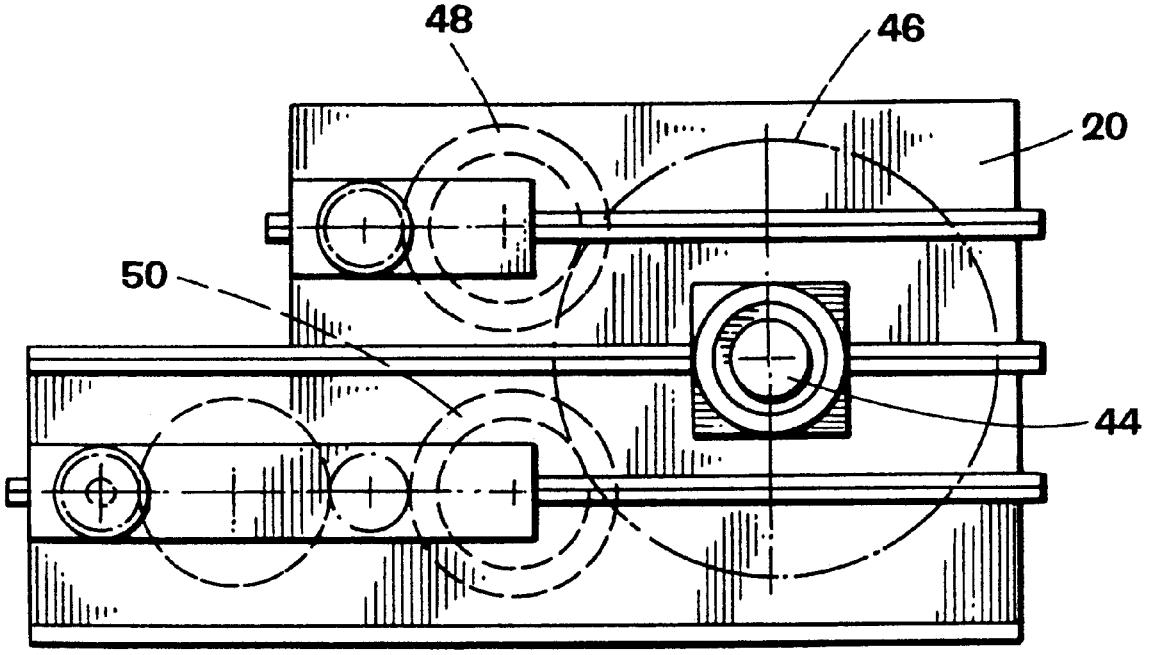
FIG. 4 is a side elevation view of the left side of the left gear box.
Figure 5:
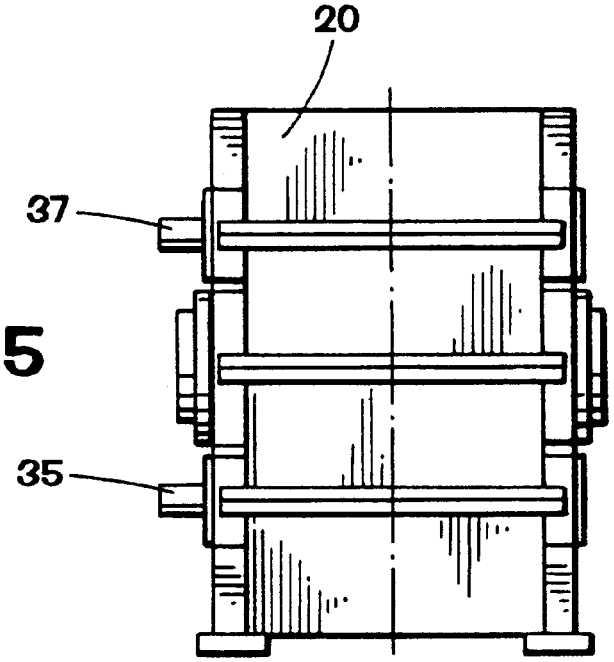
FIG. 5 is a end elevation view of the left gear box shown in FIG. 4.

In a specific embodiment, each gear box 20 and 22 is a gear reduction collector drive with integral three-speed mechanical gear transmission for each pair of motors 28, 30 and 32, 34, respectively. The gear boxes 20 and 22 of this specific embodiment may be of the type custom-manufactured by Bradfoote Gear Works, Inc., of Cicero, Ill., such as Model No. 2PH4100- 3S-21. Suitable gear boxes could also be provided by manufacturers such as: Philadelphia Gear, of King of Prussia, Pa.; Amarillo Gear, of Amarillo, Tex.; Western Gear Corporation, of Everett, Wash.; Luflkin Gear, of Lufkin, Tex., or Horsburgh & Scott, of Cleveland, Ohio. In another specific embodiment, the gear boxes 20 and 22 could be provided as single or multiple-speed transmissions instead of as three-speed transmissions. With reference to FIG. 3, which shows the left side of the left gear box 20 partially cut away, it can be more clearly seen that the upper left motor 30 is positioned above the lower left motor 28 and nearer to the drum 14. The upper right motor 34 and the lower right motor 32 are configured in the same manner. This aspect of the drawworks can also be seen with reference to FIGS. 4 and 5. FIG. 4 is a side view of the left side of the left gear box 20, and FIG. 5 is an end view, looking toward the front of the drawworks 10, of the left gear box 20 as shown in FIG. 4. The dashed, circular lines in FIG. 4 represent the three-speed gear arrangement and illustrate the manner in which the gears mesh with one another. More particularly, the left gear box 20 includes a collector gear drive 46, an upper multiple-speed gear transmission 48, and a lower multiple-speed gear transmission 50. The collector gear drive 46 is coupled to the upper and lower multiple-speed gear transmissions 48 and 50, and to the drum 14. The upper multiple-speed gear transmission 48 is coupled to the upper left motor 30, and the lower multiple-speed gear transmission 50 is coupled to the lower left motor 28. The right gear box 22 is constructed and connected to the upper and lower right motors 32 and 34 in like manner. As noted hereinabove, the drum shaft 16 runs the full length of the drawworks 10 and passes through each of the respective shaft bores provided within the left brake 24, the left gear box 20, the drum mounting frame 18, the drum 14, the right gear box 22, and the right brake 26. From FIG. 4, it can be seen that the shaft bore of the left gear box 20 is denoted by numeral 44.

As best shown in FIG. 1, left motors 28 and 30 are coupled to the input shafts 35 and 37 of left gear box 20 by mechanical couplers 36 and 38, respectively. Similarly, right motors 32 and 34 are coupled to the input shafts 39 and 41 of right gear box 22 by mechanical couplers 40 and 42, respectively. In a specific embodiment, each coupler 36–42 may be a flexible gear-type coupling, of the "Waldron" type manufactured by Kop-Flex, Inc., of Baltimore, Md. In a specific embodiment, each motor 28–34 may be a General Electric model GE-752 shunt wound high torque electric motor, each of which is rated at 1,365 horsepower. Alternatively, the drawworks 10 could be provided with two motors (not shown) instead of four, as shown in FIG. 1, in which case the gear boxes 20 and 22 would be provided with one input shaft each (not shown), instead of two, as shown in FIGS. 1, 4, and 5. Thus, motors 28 and 30 could be replaced with a single motor of greater horsepower, and motors 32 and 34 could likewise be replaced with a single motor of greater horsepower, if desired.

It is important that any drawworks be provided with sufficient braking capability to control the rotation of its drum as the wireline is being fed out to lower the drill pipe or casing. Without sufficient braking capability, due to the weight of the drill pipe and casing, the drum could freewheel out of control and thereby permit the wireline to drop at great speed, which could damage the drill pipe and casing. In a specific embodiment, the power source, such as the motors 28–34, may be provided with such braking capability. However, in other embodiments, it may be necessary to provide the drawworks with additional braking capability, such as in the form of one or more band brakes, disc brakes, electric brakes, or water-cooled brakes, for example. Thus, in the specific embodiment shown in FIGS. 1–3, the drawworks 10 is provided with left and right brakes 24 and 26. In a specific embodiment, brakes 24 and 26 may be Eaton model 436WCB water-cooled brakes. As best shown in FIGS. 1 and 2, the left and right brakes 24 and 26 are directly coupled to the left and right gear boxes 20 and 22, respectively. As best shown in FIG. 3, the drum shaft 16 is rotatably mounted within the shaft bore of the left brake 24, and the brake 24 is securely mounted to the skid 12. In another specific embodiment, the drawworks 10, if desired, could be provided with electric or disc brakes in place of water-cooled brakes. In yet another specific embodiment, the length of the drawworks 10 could be shortened by completely removing the brakes 24 and 26, and instead providing braking capability to the drawworks 10 by mounting disc or drum brakes (not shown) to the drum within the drum housing 18 at the positions indicated by numerals 24' and 26' in FIG. 1.

The total estimated weight of the specific embodiment of the drawworks shown in FIGS. 1–3 may be approximately 170,000 pounds. The drawworks 10 is provided with appropriate electrical and/or mechanical systems (not shown) to enable a oil rig worker to control the motors and other components of the drawworks 10. In a specific embodiment, the drawworks 10 may be provided with complete oil bath lubrication, in a conventional manner.

Having described the drawworks 10 of the present invention in various embodiments, it should now be understood that the drawworks 10 of the present invention is fully redundant, meaning that the drawworks 10 is provided with two complete, separate and independent systems for powering and controlling the drum 14, those two systems being: (1) the left system, which broadly comprises motors 28 and 30, gear box 20, couplers 36 and 38, and brake 24; and (2) the right system, which broadly comprises motors 32 and 34, gear box 22, couplers 40 and 42, and brake 26. Thus, in the event that any motor, gear box, coupler or brake fails, the drawworks 10 will still have the ability to raise the drill pipe out of the bore hole, or at least up into the casing, before the drill pipe becomes "stuck," thereby avoiding a very expensive and troublesome situation. In addition to significantly reducing the risk of a "stuck" pipe, the full redundancy provided with the drawworks of the present invention has the additional benefit of allowing the drilling crew to service or conduct preventative maintenance on one of the two systems without requiring the entire drilling operation to be halted.

It is to be understood that the invention is not limited to the exact details of construction, operation, exact materials or embodiments shown and described, as obvious modifications and equivalents will be apparent to one skilled in the art. For example, while the drawworks as hereinabove described has been made redundant by providing same with dual gear transmissions, it is within the scope of this invention to provide a redundant drawworks by providing same with dual chain transmissions. Accordingly, the invention is therefore to be limited only by the scope of the appended claims.

What is claimed is:

1. A redundant drawworks for use with a drilling rig, comprising:

a mounting base;

a left gear transmission assembly secured to the mounting base and having a collector gear drive and a first and a second multiple-speed gear transmission, the collector gear drive being coupled to the first and second multiple-speed gear transmissions;

a right gear transmission assembly secured to the mounting base and having a collector gear drive and a first and a second multiple-speed gear transmission, the collector gear drive being coupled to the first and second multiple-speed gear transmissions;

a drum mounted to a drum shaft, the drum shaft being rotatably coupled to the respective collector gear drives of the left and right gear transmission assemblies;

a first and second left motor secured to the mounting base, the first left motor being positioned above and nearer the drum than the second left motor, the first left motor being releasably coupled to the first multiple-speed gear transmission on the left gear transmission assembly by a first left mechanical coupler, and the second left motor being releasably coupled to the second multiple-speed gear transmission on the left gear transmission assembly by a second left mechanical coupler;

a first and second right motor secured to the mounting base, the first right motor being positioned above and nearer the drum than the second right motor, the first right motor being releasably coupled to the first multiple-speed gear transmission on the right gear transmission assembly by a first right mechanical coupler, and the second right motor being releasably coupled to the second multiple-speed gear transmission on the right gear transmission assembly by a second right mechanical coupler;

the left gear transmission assembly, the first and second left motors, and the first and second left mechanical couplers providing a complete first system which may power and control the drum;

the right gear transmission assembly, the first and second right motors, and the first and second right mechanical couplers providing a complete second system which may power and control the drum;

the first and second systems being separate from, and independent of, each other; and the first and second systems simultaneously operable to power and control the drum, or one of the systems being operable to power and control the drum, while the other system is being serviced or maintained.

2. The redundant drawworks of claim 1, further including a left brake secured to the mounting base and coupled to the drum shaft, and a right brake secured to the mounting base and coupled to the drum shaft.

3. The redundant drawworks of claim 2, further including a drum housing between the left and right gear transmission assemblies, and wherein the drum shaft is rotatably mounted within shaft bores on the drum housing, the respective collector gear drives of the left and right gear transmission assemblies, the left brake, and the right brake.

4. The redundant drawworks of claim 1, wherein power is transferred to the drum through only the left gear transmission assembly.

5. The redundant drawworks of claim 1, wherein power is transferred to the drum through only the right gear transmission assembly.

6. The redundant drawworks of claim 5, wherein preventative maintenance may be performed on the left motors and left gear transmission assembly while power is being transferred to the drum only through the right gear transmission assembly.

* * * * *